US006880316B2

(12) United States Patent
Lancaster, III et al.

(10) Patent No.: US 6,880,316 B2
(45) Date of Patent: Apr. 19, 2005

(54) METHOD AND APPARATUS FOR WRAPPING A TOP AND BOTTOM OF A LOAD

(75) Inventors: Patrick R. Lancaster, III, Louisville, KY (US); Steven Hack, Fisherville, KY (US); Steven DeGrasse, New Albany, IN (US); Don Norris, Pleasureville, KY (US); Curtis Martin, New Albany, IN (US)

(73) Assignee: Lantech.com, LLC, Louisville, KY (US)

( * ) Notice: Subject to any disclaimer, the term of this patent is extended or adjusted under 35 U.S.C. 154(b) by 0 days.

(21) Appl. No.: 09/879,052

(22) Filed: Jun. 13, 2001

(65) Prior Publication Data

US 2002/0029540 A1 Mar. 14, 2002

Related U.S. Application Data

(60) Provisional application No. 60/211,218, filed on Jun. 13, 2000.

(51) Int. Cl.[7] ..... B65B 11/00

(52) U.S. Cl. ..... 53/588; 53/203; 53/210; 53/399; 100/13; 493/299; 493/304

(58) Field of Search ..... 53/203, 210, 399, 53/441, 449, 588, 589, 590, 176, 587; 493/299, 304; 100/13, 2, 27, 28, 7

(56) References Cited

U.S. PATENT DOCUMENTS 2,630,751 A * 3/1953 Cranston et al. ..... 100/27
4,178,734 A * 12/1979 Lancaster et al. ..... 53/399
4,317,322 A 3/1982 Lancaster et al. ..... 53/399
4,393,763 A * 7/1983 Sauer et al. ..... 100/2
4,553,374 A * 11/1985 Lancaster et al. ..... 53/465
4,712,354 A 12/1987 Lancaster et al. ..... 53/399
4,761,934 A * 8/1988 Lancaster ..... 53/399
4,866,909 A 9/1989 Lancaster, III et al. ..... 53/399
4,953,336 A * 9/1990 Lancaster et al. ..... 53/556
4,979,358 A 12/1990 Keip ..... 53/556
5,027,579 A 7/1991 Keip ..... 53/133.3
5,404,691 A * 4/1995 Scherer ..... 53/399
5,505,042 A * 4/1996 Keip ..... 53/588
5,522,207 A 6/1996 Keip ..... 53/556
6,151,863 A 11/2000 Lancaster, III et al.
6,425,228 B1 * 7/2002 Lancaster et al. ..... 53/588

* cited by examiner

*Primary Examiner*—Stephen F. Gerity
*Assistant Examiner*—Thanh Truong
(74) *Attorney, Agent, or Firm*—Finnegan, Henderson, Farabow, Garrett & Dunner LLP

(57) ABSTRACT

An apparatus and method for wrapping a top and bottom of a load with packaging material is provided. The apparatus includes at least one non-driven packaging material guide is provided for use in combination with a powered conveying surface. The non-powered packaging material guide includes at least one row of non-driven wheels attached to a rail. The force applied by the packaging material as it is wrapped around the guide is supported by both the rail and the at least one row of non-driven wheels. The rail also serves to bridge any gaps between the non-driven wheels, thereby preventing capture of packaging material between the non-driven wheels. Preferably, the packaging material guide includes two rows of non-driven wheels, one on each side of the rail. Further, it is preferable that the rail connect the two rows of wheels such that the two rows of wheels form an angle of 60 degrees between them. The packaging material guide is preferably positioned above the load but may also be positioned either below the load or to the sides of the load.

36 Claims, 11 Drawing Sheets

METHOD AND APPARATUS FOR WRAPPING A TOP AND BOTTOM OF A LOAD

DESCRIPTION OF THE INVENTION

This application claims the benefit of U.S. Provisional Application No. 60/211,218, filed on Jun. 13, 2000, which is incorporated herein by reference.

FIELD OF THE INVENTION

The invention relates to wrapping a load with packaging material, and, more particularly, to stretch wrapping.

BACKGROUND OF THE INVENTION

Various packaging techniques have been used to build a load of unit products and subsequently wrap them for transportation, storage, containment and stabilization, protection and waterproofing. One system uses stretch wrapping machines to stretch, dispense and wrap stretch packaging material around a load. Stretch wrapping can be performed as an inline, automated packaging technique which dispenses and wraps packaging material in a stretch condition around a load on a pallet to cover and contain the load. Pallet stretch wrapping, whether accomplished by a turntable, rotating arm, or rotating ring typically covers the four vertical sides of the load with a stretchable film such as polyethylene film. In each of these arrangements, relative rotation is provided between the load and the packaging material dispenser to wrap packaging material about the sides of the load.

Wrapping packaging material about the sides of the loads typically unitizes and stabilizes the load. However, such side wrapping generally does not cover the top of the load or secure the load to the pallet in the manner which would promote increased stability. Because of the structure of a typical stretch wrap apparatus, it is difficult to wrap packaging material about the top and bottom of the load to secure the load to the pallet for stability. Wrapping packaging material around the top and bottom of a "loose load," commonly wrapped using the spiral method, is particularly difficult. "Loose loads" include loads made up of differently sized components, loads which have small, loose pieces placed on top of the load for wrapping with the load, very light loads, and loads of an unstable nature. Examples of such loose loads include ready to assemble furniture, stacks of printed materials, windows and doors, and office partitions. Another feature common to loose loads is that many loose loads include objects with sharp edges.

Such loose loads pose special problems in the wrapping industry. The sharp edges of the load may puncture the film as the load is being wrapped. In addition, during wrapping, the film may exert a lifting force on an initial corner of the load, or a force pushing on a top side portion of the load. Such forces unbalance loose loads. Prior art attempts to address this problem include the use of hold down devices supported from the ring wrapping frame and adapted to roll on top of the loose load. Such devices require many moving parts and often disrupt the organization of the load. Other attempts include the use of a guide, bar, or finger placed in the wrap zone to neutralize the film force on the load. The guide, bar, or finger then takes on a film load and must convey the film with the load as the load moves transversely to the wrap force. Such devices include the use of powered chains and belts, walking bars, rotating screws, air cushions, and bars coated with a friction-reducing material. All of these devices have failed in some respect. Some suffer serious limitations with respect to robustness or hampering the film movement, while others are not economically feasible.

Previous attempts to wrap packaging material about the top and bottom of a load include holding a palletized load on the tines of a forklift truck and placing the load and tines supporting the load within a wrapping mechanism to be wrapped. This method requires the driver of the forklift truck to carefully control the timing and position of the truck and the wrapping machinery revolving around the load and tines of the forklift truck to wrap packaging material about the top and bottom of the load to avoid undesirable interference between the truck, the load and the wrapping machinery during wrapping. Alternatively, the top and bottom of the load have been wrapped by conveying a load through a wrapping ring on a dual conveying mechanism such that after wrapping, the load is wrapped to the conveyor and the dual conveyor must move the load and the packaging material away from the wrapping area together. Such devices are expensive, requiring structure to keep the load and the packaging material moving at the same speed along the conveyor, preventing the packaging material from being caught on or torn, and arrangements to get electrical power to the rotating portion of the ring for controlling a dispenser mounted on the ring.

In another alternative, a load is positioned and wrapped on a cantilevered load support having a free end in the wrapping area such that a cantilevered packaging material dispenser is rotated about the load on the cantilevered load support below the free end of the cantilevered load support. Thus, the load is wrapped to the cantilevered load support and then the load must be pushed off or carried off of the load support by the following load or taken off with a conveyor. However, there is a high degree of friction involved with such movement off of the load support which may cause disorientation of the load or the film.

Additionally, the packaging material is typically spirally wrapped and made up of up to 40 individual wraps. Due to the nature of the spiral, some packaging materials develop ropes along their edges. The packaging material is designed to bond to itself and therefore is quite tacky. These characteristics make it difficult to slide the packaging material over any fixed surface where significant forces are incurred. Several approaches have been disclosed to drive the packaging material on a conveying means parallel to the direction of the travel of the load. These include patents issued to Lantech Inc. and to Keip Machine Co. These systems depend on relatively expensive and complex drive mechanisms to drive the packaging material independently of the force of the load.

Due to the expensive nature of the independent drives required to drive the packaging material and the load, other attempts have been made to use non-powered mechanisms to carry the packaging material. Such attempts include the use of rollers, belts, chains, low friction coatings, air bearings, slider bars, screws, reciprocating feet, and air jets for a non-powered packaging material carrier. Each of these has suffered difficulty in robustly allowing the transverse movement of the load to slide the packaging material off the load support conveyor or platform.

High drag force can distort the load, split the packaging material or cause the load drive conveyor to slip. Particular problems with attempts to use rollers and wheels include offsetting the wheels which allows them to catch the loose packaging material, and allowing ropes of packaging material to become caught between the wheels and thus lock the wheels, preventing the packaging material from moving along the rollers. In a further attempt to create a non-powered device, side bars were added to the rollers to carry some of the force of the packaging material and prevent jamming of the rollers. However, the friction created between the packaging material and the bars was too great, preventing easy movement of the packaging material and causing tearing of the packaging material and sticking between the packaging material and side bars.

In light of the drawbacks associated with providing expensive powered conveyors which move the packaging material and the load at the same speed, the friction problems associated with simply pushing the load off of a load wrapping surface, and in light of the special problems associated with wrapping loose loads, there is a need to wrap the top and bottom of the load with packaging material in the simple, reliable and inexpensive manner which will also allow for the removal of the load from the wrapping surface without tearing, friction or expensive mechanisms to do so. The present invention permits wrapping of the top and bottom of loose loads during continuous wrapping and solves the problem of the delicate balance between protecting the wheels from locking up and prevention of a high friction contact.

SUMMARY OF THE INVENTION

In accordance with the invention, a method and apparatus for wrapping a top and bottom of a load with packaging material are provided. The apparatus and method provide advantages over and obviate several problems associated with earlier methods and apparatus for wrapping a top and bottom of a load.

According to one aspect of the present invention, an apparatus for wrapping a top and bottom of a load with packaging material is provided. The apparatus includes a surface for supporting and moving a load, a packaging material dispenser, means for providing relative rotation between the packaging material a dispenser and the load, and at least one packaging material guide including a rail and at least one row of non-driven wheels attached to a side of the rail, wherein the wheels are positioned with respect to a surface of the rail to permit both the rail and the wheels to support a force applied by the packaging material during wrapping.

According to another aspect of the invention, an apparatus for wrapping a top and bottom of a load includes a load conveyor for supporting and moving a load during wrapping, a packaging material conveyor for supporting and moving packaging material wrapped around the load and the packaging material conveyor during wrapping, a packaging material dispenser, means for providing relative rotation between the packaging material dispenser and the load, and at least one packaging material guide including a rail and at least one row of non-driven wheels attached to a side of the rail, wherein the wheels are positioned with respect to a surface of the rail to permit both the rail and the wheels to support a force applied by the packaging material during wrapping.

According to another aspect of the invention, an apparatus for wrapping packaging material around a top and bottom of a load includes a load conveyor for supporting and moving a load, a packaging material dispenser, means for providing relative rotation between the packaging material dispenser and the load, and at least one packaging material guide for supporting and moving packaging material wrapped around the load, the load conveyor, and the packaging material guide during wrapping, the at least one packaging material guide including a rail and at least one row of non-driven wheels attached to a side of the rail, wherein the wheels are positioned with respect to a surface of the rail to permit both the rail and the wheels to support a force applied by the packaging material during wrapping.

According to yet another aspect of the invention, a method of wrapping a top and bottom of a load with packaging material is provided. The method includes positioning a load on a surface for supporting and moving the load during wrapping, positioning at least one packaging material guide including a rail and at least one row of non-driven wheels attached to a side of the rail, wherein the wheels are positioned with respect to a surface of the rail to permit both the rail and the wheels to support a force applied by the packaging material during wrapping, providing relative rotation between a packaging material dispenser and the load to wrap packaging material around the top and bottom of the load and around the rail and non-driven wheels of the packaging material guide, and rotating the non-driven wheels of the packaging material guide by moving the packaging material over the wheels and the rail as the load is removed from the surface for supporting and moving the load to place the packaging material in contact with the load.

According to another aspect of the invention, an apparatus for wrapping packaging material around a top and bottom of a load includes a surface for supporting and moving a load during wrapping, a packaging material dispenser, and at least one packaging material guide including a rail and at least one row of non-driven wheels attached to a side of the rail for supporting and moving the packaging material below the surface during wrapping.

According to another aspect of the invention, an apparatus for wrapping packaging material around a top and bottom of a load includes a surface for supporting and moving a load, a packaging material dispenser, means for providing relative rotation between the packaging material dispenser and the load, and at least one packaging material guide including a rail and at least one row of non-driven wheels attached to a side of the rail, wherein the packaging material guide is movable from a position above the surface to a position below the surface to position the wheels and a surface of the rail to support a force applied by the packaging material during wrapping.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

The present invention incorporates by reference U.S. Pat. Nos. 4,317,322, 4,712,354, 4,866,909, 4,979,358, and 5,027,579. The following text and accompanying drawings illustrate examples of the present preferred embodiments of the present invention. As used herein, the terms "packaging material" and "film" are interchangeable.

Figure 12A:
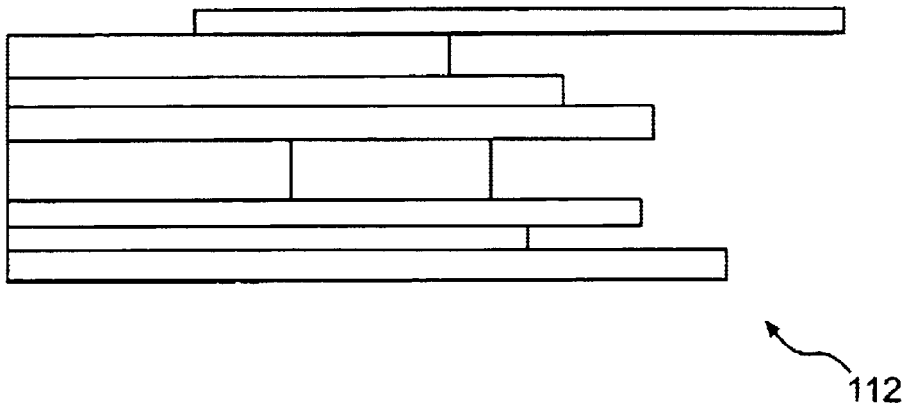
FIG. 12A is a side view of an example of a loose load.
Figure 12B:
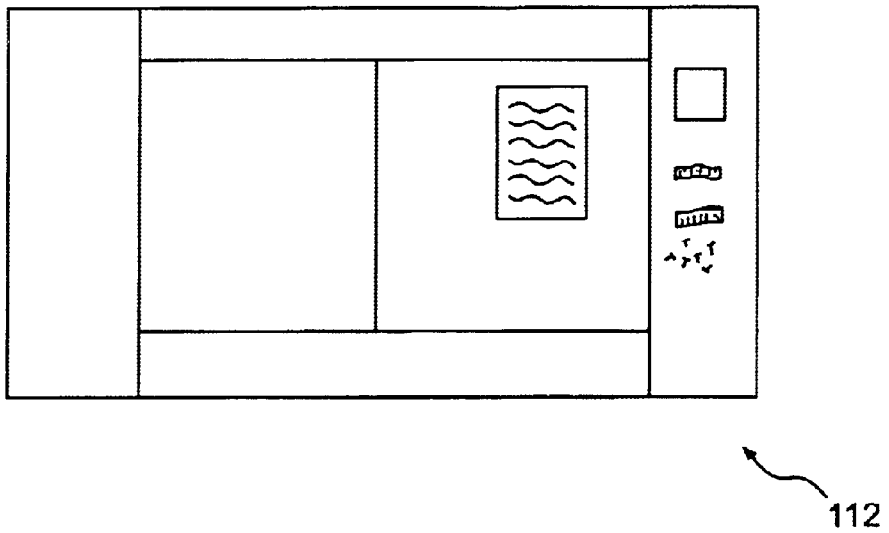
FIG. 12B is a top view of another example of a loose load.

The present invention provides a method and apparatus for wrapping a load. The apparatus provided substantially reduces the problems typically associated with the wrapping of loose loads. As embodied herein and shown in FIGS. 12A and 12B, "loose loads" include loads made up of differently sized components, loads which have small, loose pieces placed on top of the load for wrapping with the load, very light loads, and loads of an unstable nature. Examples of such loose loads include ready to assemble furniture, stacks of printed materials, windows and doors, and office partitions.

The apparatus and method of the present invention provide at least one film guide to support the force of the packaging material as the top and bottom of the load are wrapped. By supporting the packaging material during wrapping, the present invention prevents the load from shifting during initial wrapping, prevents the film from lifting the edge of the product during wrapping, and evenly distributes the force of the packaging material applied to sharp corners or edges of the load, thus preventing puncturing or tearing of the film.

Although the apparatus and method of the present invention are particularly useful for wrapping loose loads during continuous spiral wrapping, the film guide of the present invention can be easily incorporated into other wrapping apparatus and methods to provide more efficient wrapping of the top and bottom of any type of load. In particular, the film guide of the present invention can be incorporated into a conventional ring wrapping device to replace the chains or belts which typically carry the packaging material below the top load conveying surface.

As embodied herein, one aspect of the present invention includes an apparatus 100 provided for wrapping a top and bottom of a load with packaging material. The apparatus 100 includes a wrapping ring, a load conveyor, a film conveyor, a film dispenser, means for providing relative rotation between the dispenser and the load, and at least one film guide. As embodied herein and shown in FIGS. 1A–2 and 4, a ring wrapping apparatus 100 includes a conveying apparatus 110, a film conveying apparatus 111, a packaging material dispenser 116 (which may include a cutting mechanism, not shown) for dispensing packaging material 114, and at least one film guide 120.

Figure 1A:
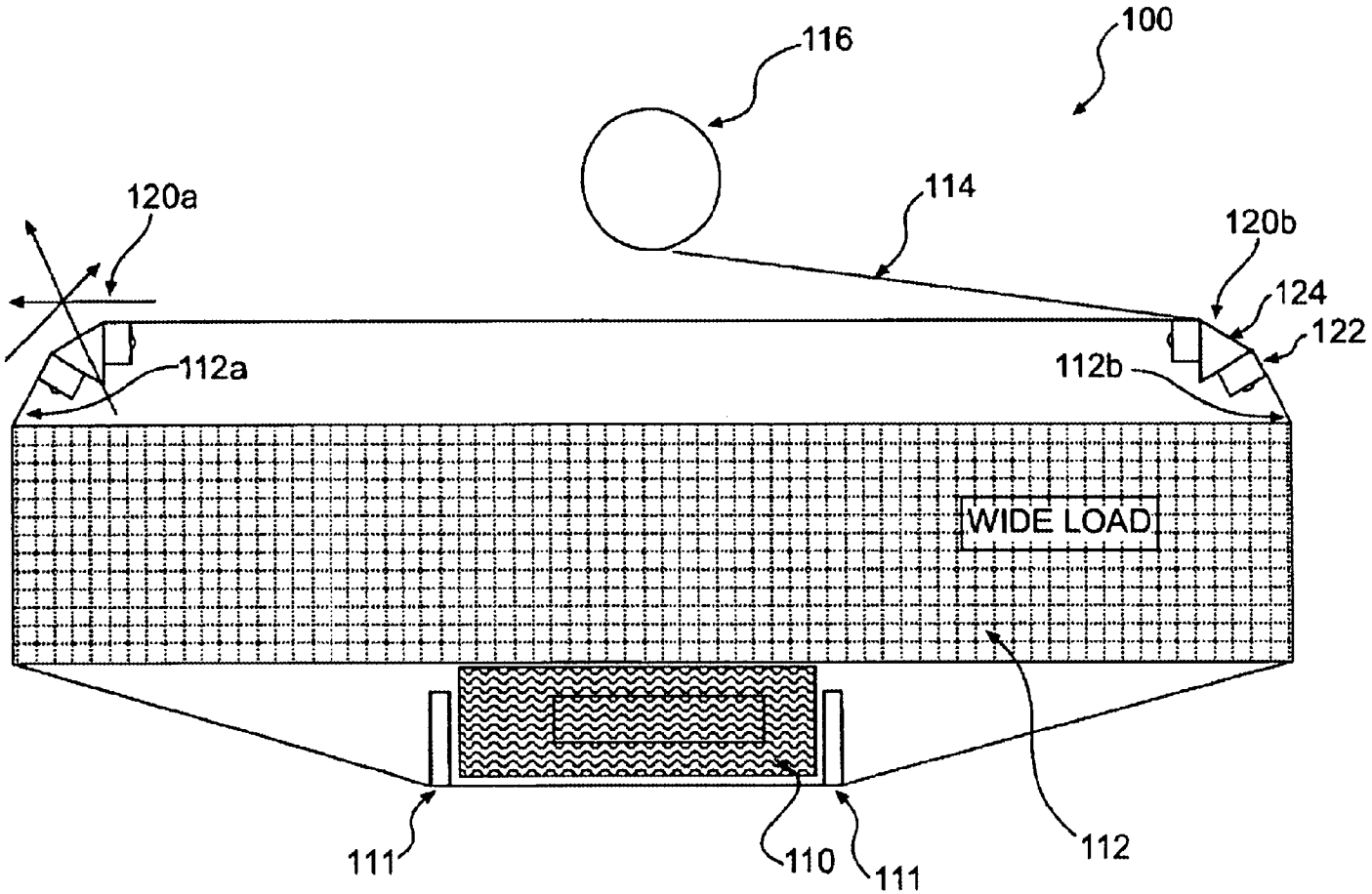
FIG. 1A is a front cross-sectional view of a portion of an apparatus for wrapping a load according to one aspect of the present invention.
Figure 1B:
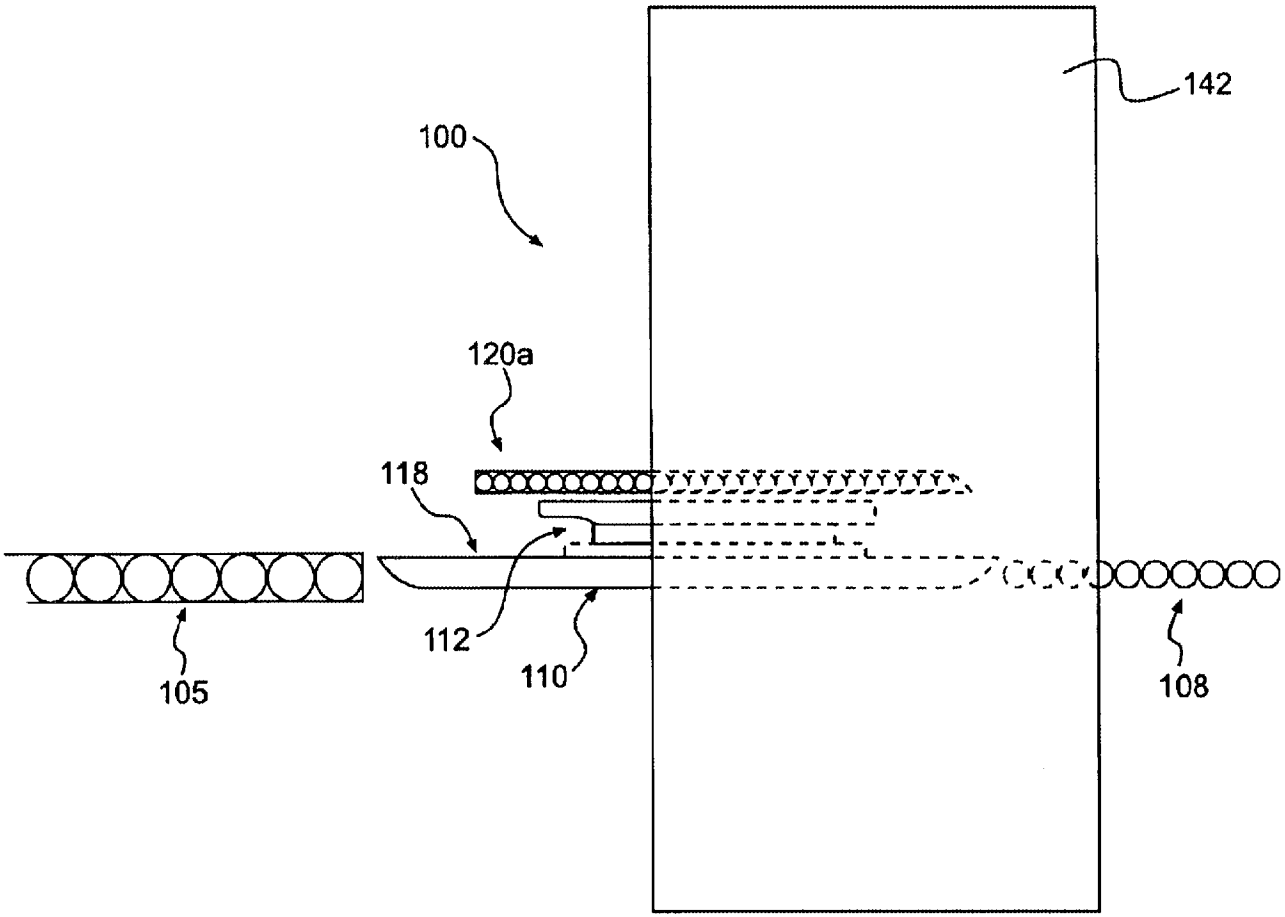
FIG. 1B is a side cross-sectional view of the apparatus of FIG. 1A.

As shown in FIG. 1B, a load 112 is provided from an infeed conveyor 105 to wrapping conveyor 110, or is directly placed on wrapping conveyor 110 and is conveyed into the wrapping area. The wrapping area, as shown in FIG. 1B and as will be described in greater detail below, includes means for providing relative rotation between a packaging material dispenser and the load. Preferably, the means for providing relative rotation include a wrapping frame 142 on which a steel donut or ring shaped packaging material support member (not shown) is rotatably mounted and supported. The wrapping ring supports a packaging material dispenser 116 which rotates around the ring to dispense and wrap packaging material 114 around the load 112. After the load 112 is wrapped, load 112 moves off load wrapping conveyor 110 onto a take-off conveyor 108.

The load wrapping conveyor 110, as shown in FIGS. 1A and 2B, comprises a load supporting and conveying surface 118. The load supporting and conveying surface 118 is a standard plate type conveyor well known in the art comprising a driven endless belt mounted on a plurality of rollers. The endless belt is rotated in a direction which moves anything on the belt through the wrapping frame 142 in a direction from the infeed conveyor 105 toward the take-off conveyor 108. The belt is preferably driven by a motor assembly. Adjacent to and protruding slightly below conveyor 110, and preferably positioned on either side of conveyor 110, are chains 111. Chains 111 are provided to move the packaging material 114 which will be wrapped below conveyor 110 and supported on chains 111 during the wrapping process. Preferably conveyor 110 moves at the same speed as chains 111 such that the load 112 and the packaging material 114 wrapped about the load move at the same speed. Chains 111 typically rotate in a direction opposite to that of conveyor 110 to facilitate movement of packaging material 114 in the same direction that load 112 is moving, toward take-off conveyor 108. Chains 111 are preferably metallic but may be replaced by any suitable alternative for moving the packaging material, for example, an additional conveyor or rubber belts.

Figure 2:
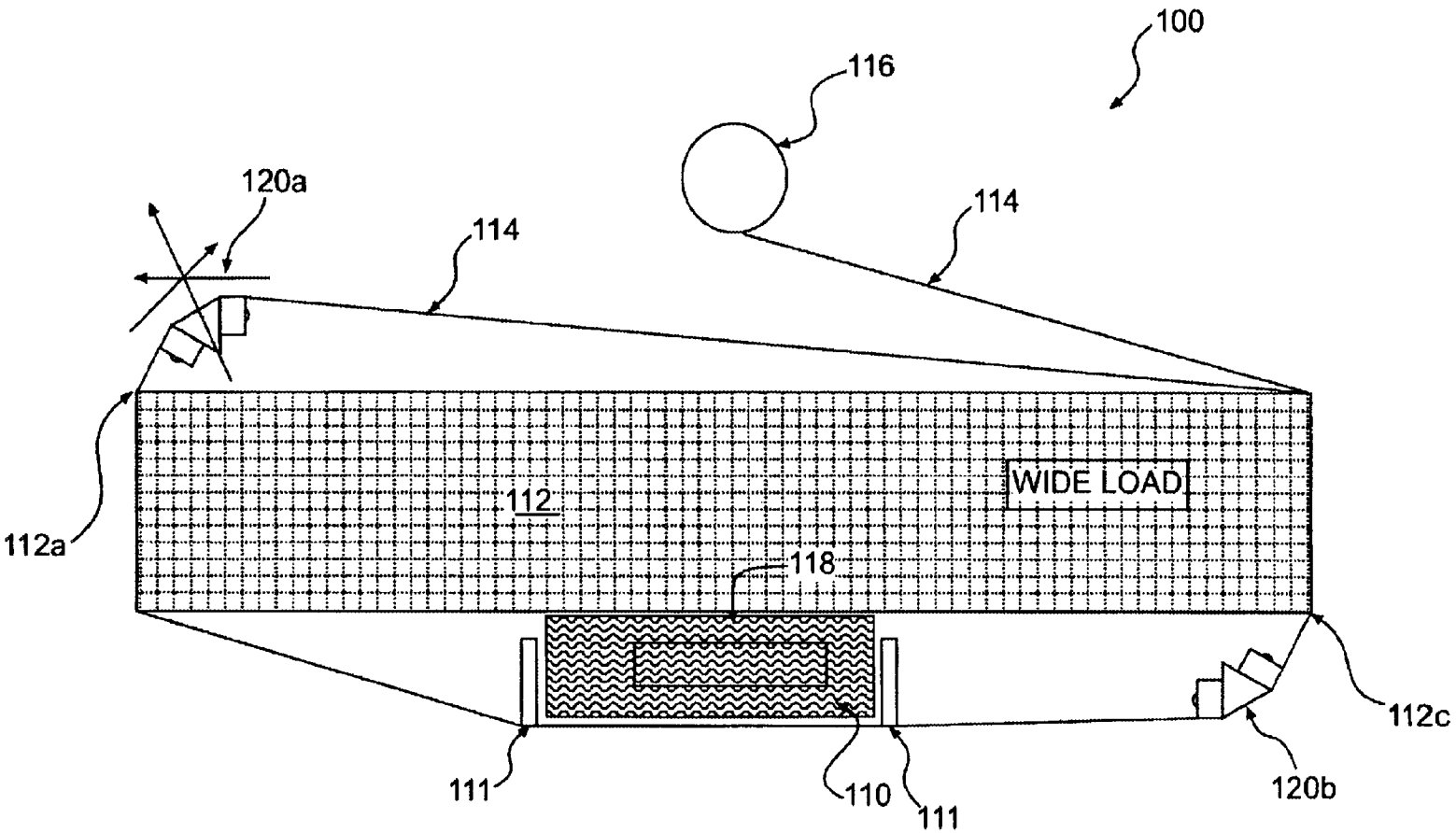
FIG. 2 is a front cross-sectional view of the apparatus of FIG. 1A showing the film guides in an alternative configuration.
Figure 3:
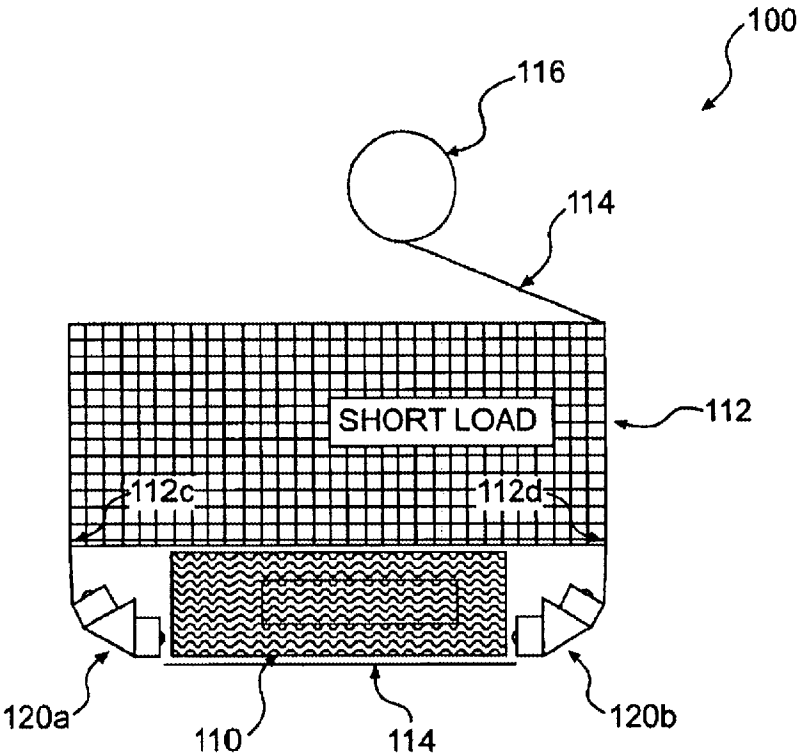
FIG. 3 is a front cross-sectional view of the apparatus of FIG. 1A showing the film guides in another alternative configuration.

Although film guide(s) 120 are shown positioned above the conveyor in FIGS. 1A–2 and 4, it is possible to position the film guide(s) 120 below the load 112 and adjacent load conveyor 110. In such an embodiment, two film guides 120 should be positioned slightly below and on either side of the load supporting and conveying surface 118. This alternative will be further discussed with respect to the embodiment shown in FIGS. 6 and 7. However, as shown in FIGS. 3 and 5, in such a configuration, film guide(s) 120 replace the chains 111. By eliminating use of the chains, it is possible to eliminate a source of potential mechanical problems as well as a structure which may tend to catch or tear the packaging material. Chains also have the tendency to collect bits of packaging material which may eventually bind the chain and prevent movement of the packaging material during wrapping. For these reasons it is desirable to replace chains 111 with the film guides 120 of the present invention.

In addition to load wrapping conveyor 110 and chains 111, wrapping apparatus 100 includes at least one film guide 120. As embodied herein and shown in FIG. 1, it is preferable to use two film guides 120*a*, 120*b*. As shown in FIG. 1A, film guides 120*a*, 120*b* may be positioned above the load 112 located on surface 118 of conveyor 110. Film guides 120*a*, 120*b* positioned above load 112 are preferably positioned just inward of the respective top corners 112*a*, 112*b*, of load 112.

Figure 8:
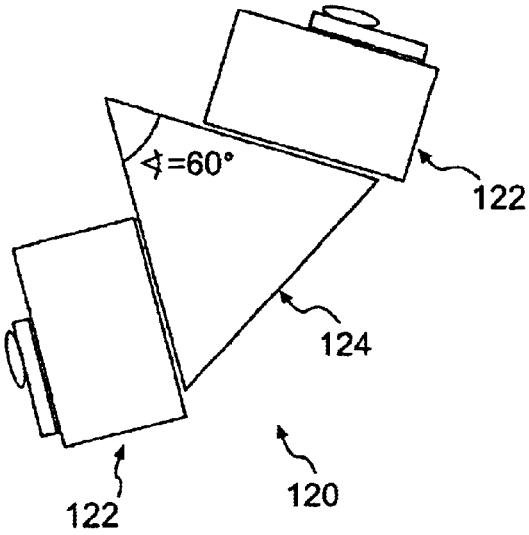
FIG. 8 is a front cross-sectional view of a film guide for use in the wrapping apparatus of the present invention.
Figure 9:
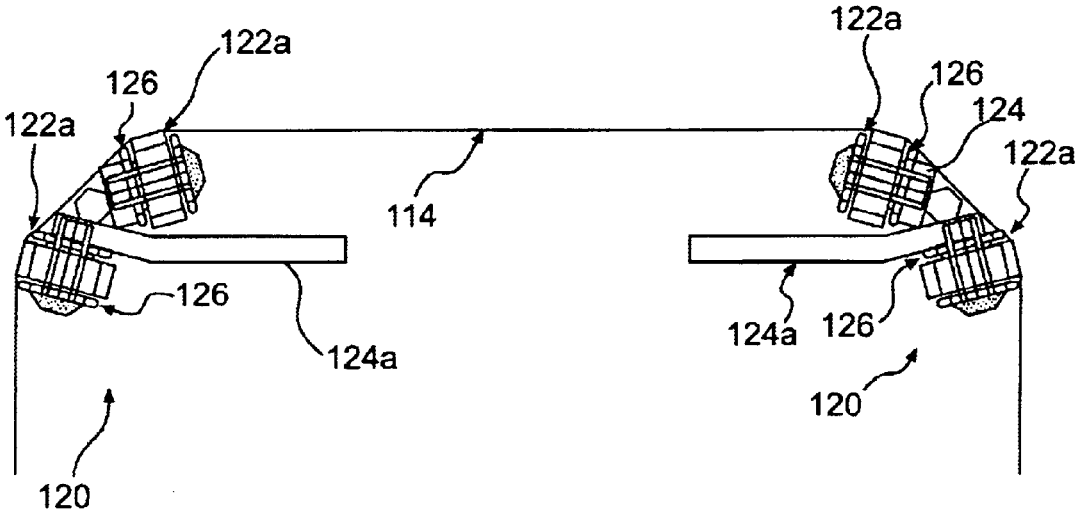
FIG. 9 is a front cross-sectional view of a pair of alternative film guides for use in the wrapping apparatus of the present invention.
Figure 10:
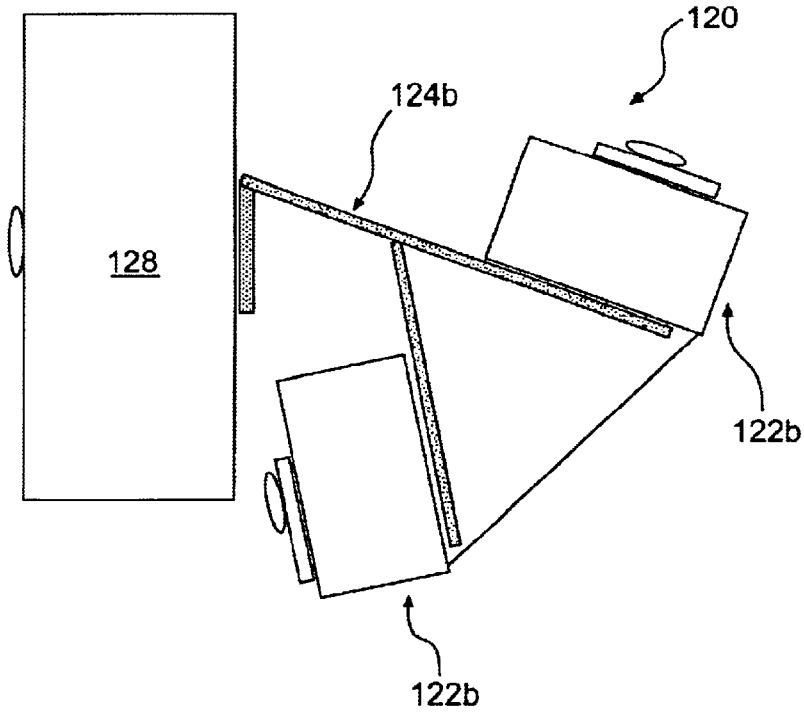
FIG. 10 is a front cross-sectional view of another film guide for use in the wrapping apparatus of the present invention.

As shown in FIGS. 8–10, each film guide 120 includes wheels or rollers 122, 122*a*, or 122*b* mounted on either side of a rail 124, 124*a*, 124*b*. There are preferably two rows of wheels 122 provided, one row disposed on each side of rail 124. The wheels 122 are non-driven wheels, i.e., no power source has been provided to drive or rotate the wheels 122. The wheels 122 are rotated by movement of the packaging material 114 along rail 124 and wheels 122 of film guide 120 as the packaging material 114 wrapped around load 112, conveyor 110, and chains 111 moves as load wrapping conveyor 110 and chains 111 move. Although it is preferred that two rows of wheels 122 be used with each rail 124, it is possible to use only one row of wheels 122 or to use more than two rows of wheels 122.

Rail 124 may be made of any suitable materials, such as metals, that are of sufficient strength to bear the force applied by the film during wrapping. The rail is more effective if it has not been painted. In addition, the rail may be treated with a material such as zinc dichromate to minimize tacky film adhesion.

As shown in FIG. 8, rail 124 may have a triangular cross-section. Alternatively, as shown in the presently preferred embodiment of FIG. 9, rail 124 may be formed from more than one piece of material in order to form the proper angle between the rows of wheels. In such a case, wheel 122 is preferably mounted to an intermediate rail 126, having a series of holes for receiving the wheel mountings and positioned between wheel 122 and rail 124. Intermediate rails 126, shown in FIG. 9, bear the portion of the force of the film carried by film guide 120 to be borne by the rail 124.

Rails 124 may be mounted within wrapping frame 142 or may be mounted outside of wrapping frame 142. Preferably, rails 124 are slightly longer than the width of the web of packaging material being used to wrap the load. For example, for a web of packaging material with a width of 20 inches, the rail 124 is preferably at least 23 inches long. It is also preferable that the length of the rail 124 which corresponds to the width of the packaging material web includes the rows of wheels 122 along its length. This is more preferable for continuous wrapping, during which it is necessary that the wrapping occur on the wheeled portion of the rail. The downstream end of each rail 124 is preferably tapered to provide ease of release of the packaging material from the film guides. The tapering may be of any suitable angle which facilitates exiting of the packaging material from the film guide. The tapered end of the rail preferably includes non-driven wheels 122. Alternatively, the tapered end of the rail 124 need not include wheels.

Wheels 122, 122*a*, 122*b* are also mounted on rail 124 to provide optimum contact between the rail 124 and the film. It is preferred that the rail 124 support approximately 25% of the film force applied to the film guide 120 and that wheels 122 positioned on either side of rail 124 support the other 75% of the film force applied to the film guide 120. Thus, the wheels 122 must protrude sufficiently above the surface of the rail 124 such that they bear 75% of the film force. Alternatively, the rail may bear 75% of the film force and the wheels only 25% of the film force. In a most preferred embodiment, the rail 124 carries 50% of the film force and the wheels carry the other 50% of the film force. It is also preferred that the wheels of one row are offset with respect to the wheels of the other row such that when the film is located between two wheels on one side of the rail 124, the film is supported by a wheel on the other side of the rail.

Rail 124 is preferably of such a shape and size that the wheels 122 of one row form a preferred angle of 60 degrees with respect to the second row of wheels 122. An angle of 60 degrees between the rows of wheels 122 is the most preferred angle because it allows the film guide 120 to be used in a wide range of wrapping operations including continuous spiral wrapping. The most preferential angle will vary from application to application, from about 30 degrees to about 120 degrees, depending upon the size of the load to be wrapped and the type of wrapping to be performed, continuous or discrete/segmented, but the preferred angle of 60 degrees will allow the film guide to function in all types of wrapping applications. Rail 124 can be mounted for full positioning and rotation in the x, y, and z directions in order to provide optimum contact with the film. Thus, it is possible to move the film guide 120 from a position above the load 112, as shown in FIG. 1A, to a position below the load, as shown in FIG. 5. As embodied herein and shown in FIG. 1A, the film guide 120*a* is movable independently from film guide 120*b*, such that it is possible to move the film guides 120*a*,120*b*, from the position shown in FIG. 1A to a position where film guide 120*a* is above the load 112 and film guide 120*b* is below the load, as shown in FIG. 2. In addition, as shown in FIGS. 3 and 5, it may be possible to adjust the distance between film guides 120*a*, 120*b* in order to accommodate both narrow and wide packages with the same wrapping apparatus. For example, as shown in FIG. 3, for a narrow load, film guides 120*a*, 120*b* may be positioned adjacent either side of load wrapping conveyor 110. For a wide load, as shown in FIG. 5, film guides 120*a*, 120*b* may be positioned distant from either side of load wrapping conveyor 110 so as to be positioned just inside the edges of a wide load 112. Alternatively, film guides 120*a*, 120*b* may be moveable in only a single direction, such as the x direction, or in any combination of any of the x, y, and z directions, or it may not be moveable at all.

Figure 11:
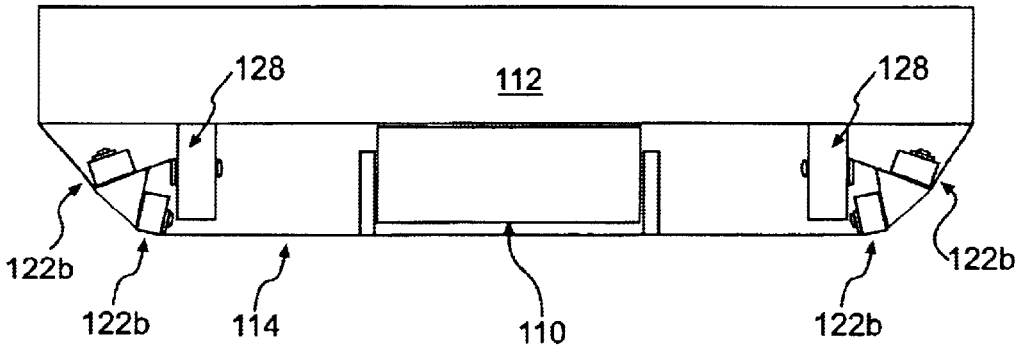
FIG. 11 is a front cross-sectional view of a portion of an apparatus for wrapping a load including the film guide of FIG. 10.

As embodied herein and shown in FIGS. 10 and 11, film guide 120 may include a load support portion connected to the film guide. In such an embodiment, the load support portion includes a row of rollers 128. Rollers 128 are preferably of sufficient size to support the remainder of the film guide 120 and to support a portion of an oversized load 112 hanging off of conveyor 110 as shown in FIG. 11. Preferably, rollers 128 are roller skate wheels. Rollers 128 are non-powered rollers which rotate as load 112 moves along them, driven by conveyor 110. Rollers 128 are attached to a portion of rail 124 and are moveable with film guide 120.

The choice of the number of film guides 120 used and the type of wheel assembly used are dependent upon the type and size of the load 112 to be wrapped. For example, when the film guides 120*a*, 120*b* are in the configuration shown in FIG. 1A, i.e., both above the load 112 and slightly inward of the upper corners 112*a*, 112*b*, of the load, film guide 120*b* acts to prevent the load from shifting as the packaging material wraps around the load, moving in a direction from corner 112*b* to corner 112*a*. When the film guides 120*a*, 120*b* are in the configuration shown in FIG. 3, i.e., both under the load 112 and near the conveyor 110, the film guides 120*a*, 120*b* prevent pressure points in the packaging material and they eliminate the need for chains 111 to carry the packaging material as discussed previously. When in the configuration shown in FIG. 2, i.e., with one film guide 120*a* above the load 112 and near a corner 112*a* of the load and a second film guide 120*b* below the load and near a diametrically opposed corner 112*c*, film guide 120*a* prevents load 112 shifting and film guide 120*b* prevents the packaging material 114 from lifting the edge of the load 112. When the film guides 120*a*, 120*b* are in the configuration shown in FIG. 5, i.e., both below the load 112 and away from the conveyor 110 toward respective lower corners 112*d*, 112*c* of the load, film guide 120*b* prevents the packaging material from lifting the edge of the load 112 during wrapping and film guides 120*a*, 120*b* eliminate the need for the use of chains 111, making the apparatus more mechanically and economically efficient.

Figure 4:
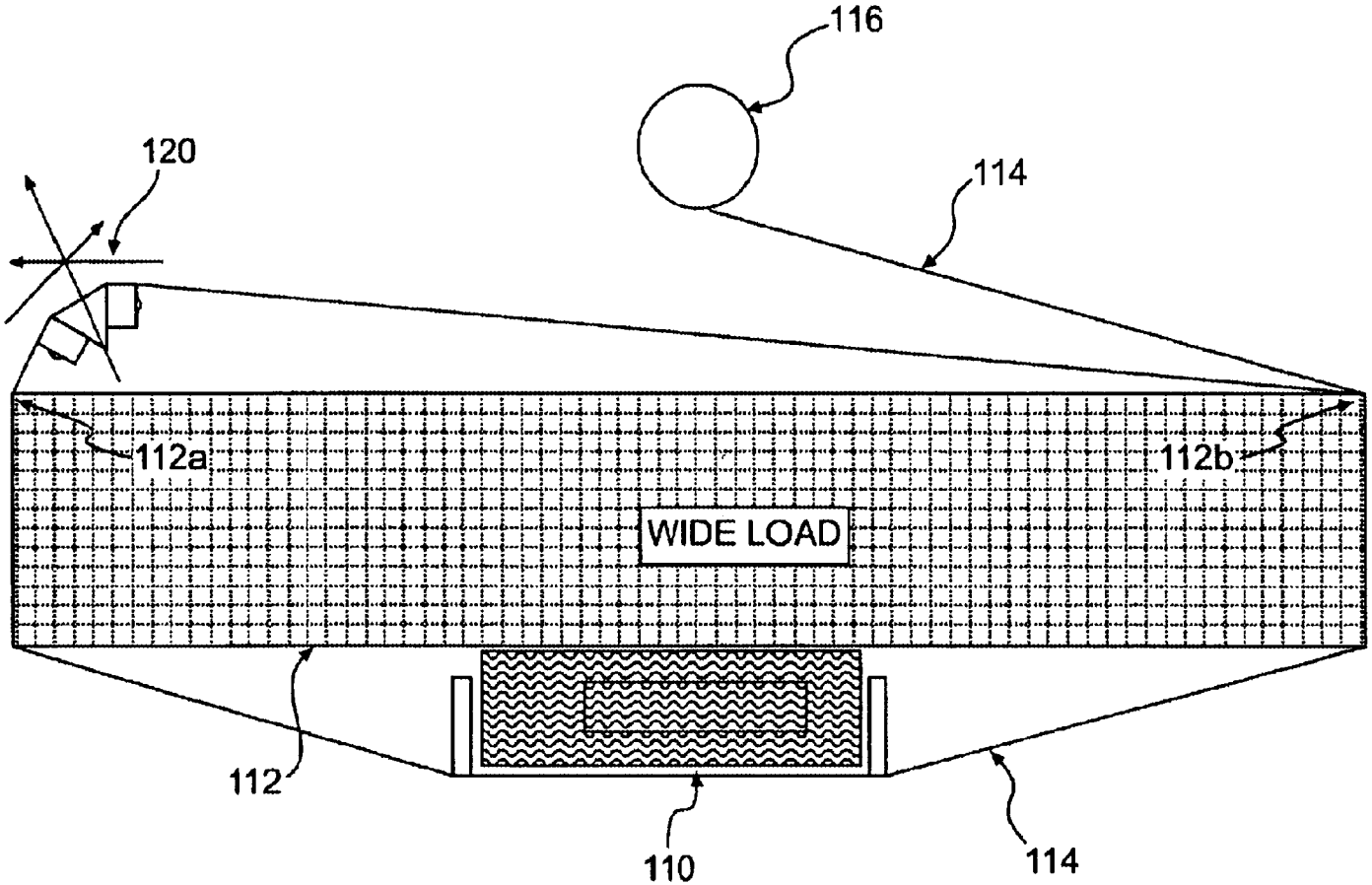
FIG. 4 is a front cross-sectional view of an apparatus for wrapping a load according to another aspect of the present invention.
Figure 5:
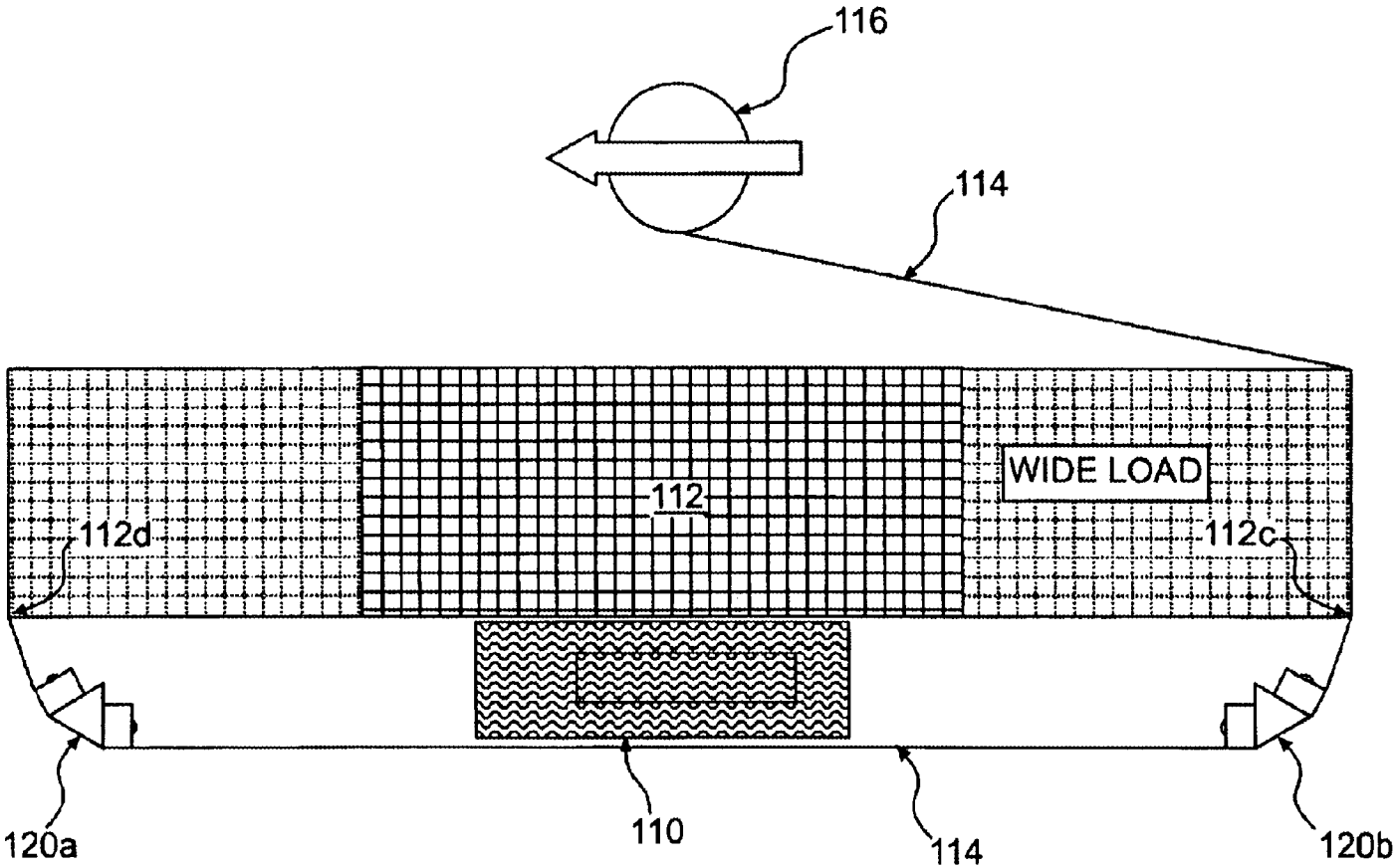
FIG. 5 is a front cross-sectional view of the apparatus of FIG. 1A showing the film guides in another alternative configuration.

Although it is preferable to use two film guides 120*a*, 120*b*, it is possible to use only a single film guide 120 as shown in FIG. 4. In such a configuration, the film guide 120 is preferably positioned slightly above the load 112 and slightly inward from the corner 112*a* of the load 112. Positioning of the film guide 120 in such a location prevents shifting of the load 112 during wrapping when the wrapping moves from above a corner 112*b* of the load 112 without the film guide 120 to above the corner 112*a* of the load where film guide 120 is positioned.

A method for wrapping a top and bottom of a load as embodied in FIGS. 1A–2 and 4 will now be described. According to one preferred embodiment of the present invention, a load 112 is transported, either via a infeed conveyor 105 or by a forklift or other means, to a wrapping area including load wrapping conveyor 110. Load 112 is placed on load supporting and conveying surface 118 of load wrapping conveyor 110. At least one film guide 120 is positioned above the load 112 and slightly inward of a corner 112*a* of the load 112 (FIG. 4). If two film guides 120*a*, 120*b* are used, each film guide 120*a*, 120*b* is positioned above the load 112, and slightly inward from a respective upper corner 112*a*, 112*b* of the load 112 (FIG. 1A). If necessary, film guide 120*a*, 120*b* may be rotated to optimize the amount of contact between the rail 124 of film guide 120*a*, 120*b* and the packaging material 114 to be wrapped around the load 112. In addition, if necessary, the distance between film guides 120*a*, 120*b* may be adjusted to accommodate the width of the load 112, as discussed previously with respect to FIGS. 3 and 5. Regardless of the number of film guides 120 used, or the number of rows of wheels 122 contained on each film guide 120, the steps of orienting the film guides 120 with respect to the load 112 remains the same.

A leading end portion of a sheet of packaging material 114 is attached to the load 112, and packaging material dispenser 116 is rotated around a ring within wrapping frame 142. As packaging material dispenser 116 revolves around the wrapping ring, it dispenses packaging material 114 around the load 112, load wrapping conveyor 110, film guide(s) 120, and chains 111. As the film passes over film guide(s) 120, the force of the film 114 is supported by film guide(s) 120. Preferably, within each film guide 120 the force applied by the packaging material 114 is supported evenly between the rows of wheels 122 and the rail 124. That is, in a most preferred embodiment, the rail 124 supports 50% of the force applied by the packaging material 114 and the two rows of wheels 122 support the other 50% of the force applied by the packaging material 114. The actual amount of force supported by each of the rows of wheels 122 and by the rail 124 will depend on the alignment of the film guide 120 with respect to the load 112 and to the packaging material 114 being applied.

As embodied herein and shown in FIGS. 1A, 2, and 4, as the packaging material 114 is being wrapped around load 112, conveyor 110, chains 111, and film guide(s) 120, load wrapping conveyor 110 and chains 111 begin to rotate in opposite directions. As conveyor 110 and chains 111 move, load 112 moves on load supporting and conveying surface 118 of load wrapping conveyor and the packaging material 114 applied to load 112 moves with chains 111 on the lower surface of the chains 111. As the load 112 moves on conveyor 110, packaging material 114 is continuously wrapped around the load 112, the conveyor 110, the chains 111, and the film guide(s) 120 to form a spiral wrap. As the packaging material 114 moves with the load 112 and chains 111, it also moves along film guide(s) 120. The non-driven wheels 122 of the film guide(s) 120 begin to rotate as packaging material 114 wrapped around the film guide(s) 120 moves with the load 112 and is carried on chains 111 in the same direction that the load 112 is carried on the conveyor 110, facilitating further movement of the packaging material 114 along the film guide(s) 120. In addition, the film 114 slides along the rail 124 of film guide(s) 120. Because the force applied by the packaging material 114 is evenly carried by the rail 124 and the rows of wheels 122, the packaging material 114 does not get caught between the wheels 122 or stick to the rail 124. As the load 112 is wrapped, it passes through the wrapping frame 142 and approaches the end of conveyor 110 and the front end of take-off conveyor 108. Between wrapping conveyor 110 and take-off conveyor 108 is a slight gap. As the load 112 reaches the end of wrapping conveyor 110 and film guide(s) 120, the packaging material 114 wrapped around the film guide(s) 120 reaches the tapered portion of the rail 124. The film 114 moves along the tapered portion of rail 124 and off of film guide(s) 120 to snap into place adjacent to the load 112.

During continuous spiral wrapping, another load closely follows the first, such that the front end of the new load is being wrapped while the rear end of the first load is being wrapped. There is sufficient space between the loads to allow the packaging material to snap into place around each load and still leave a space between each load. Downstream of the wrapping conveyor, on the take-off conveyor or elsewhere, the spirally wrapped loads which are connected to one another by the packaging material are separated from one another.

During discrete or segmented wrapping, the conveyor stops moving so that the packaging material can be severed after the load is fully wrapped. Then, the load is conveyed off of the wrapping conveyor onto the take-off conveyor. The wrapping process then starts again with a new load, the first step being that of attached a free end of the packaging material to the new load.

According to another aspect of the present invention, the use of film guides 120 replace chains 111. As embodied herein and shown in FIGS. 6 and 7, an apparatus 200 for wrapping a top and bottom of a load with packaging material is provided. The apparatus 200 includes a packaging material dispenser 216, means for providing relative rotation between the dispenser and the load, a load wrapping conveyor 210, and two film guides 220*a*, 220*b*.

Figure 6:
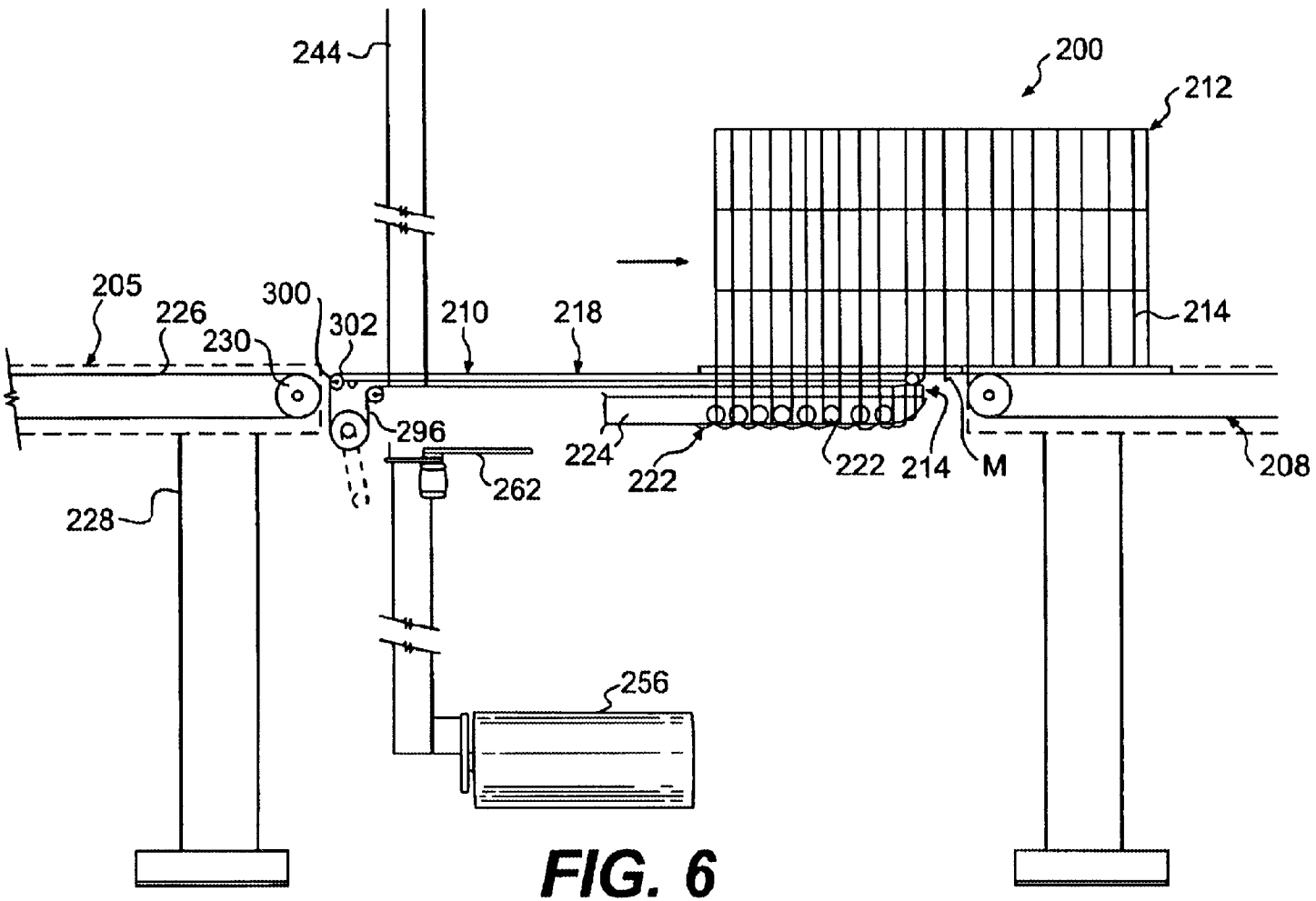
FIG. 6 is a side cross-sectional view of an apparatus for wrapping a top and bottom of a load according to another aspect of the present invention.

As shown in FIG. 6, a load 212 is placed on an infeed conveyor 205 which includes an endless belt 226 mounted on a frame support 228. The endless belt 226 is mounted on rollers 230 which are rotatably journaled by suitable bearing means and brackets which are secured to the frame support 228. The infeed conveyor 205 carries the load 212 onto a wrapping station 241 including a packaging material dispensing apparatus 216 and a wrapping conveyor 210.

The wrapping apparatus includes means for providing relative rotation between the load 212 and the packaging material dispenser 216. Preferably, the means for providing relative rotation include a frame 242 on which a steel donut or ring shaped packaging material support member 244 is rotatably mounted and supported on three planes by guide rollers 246. If desired, the packaging material support member 244 can be constructed of aluminum. A plurality of guide rollers 246 project inward from the frame 242 on arms 247 and mounting plates 248 to engage the ring shaped member 244 so that it can be driven in a predetermined path. A friction drive wheel 249 is positioned adjacent the ring member 244 at its base and engages the member 244 to rotate the member 244 within the guide wheel rolling area. The friction drive wheel 249 is driven by a motor 250 having a shaft which is suitably connected with a drive reducer 252. Material roll dispensing shaft 254 is rotatably secured to the ring member 244 for rotation on its axis and is adapted to receive and hold a roll of packaging material 256.

The load wrapping conveyor 210 comprises a load supporting and conveying surface 218. The load supporting and conveying surface 218 is a standard plate type conveyor well known in the art comprising a driven endless belt 296 mounted on a plurality of rollers 300. The rollers 300 are supported by plates 302 secured in turn to a frame member (not shown) which holds the rollers in a rotatable position. The endless belt 296 is rotated in a direction which moves anything on the belt 296 through the wrapping device 241 in a direction from the infeed conveyor 205 toward the take-off conveyor 208. Belt 296 is driven by a motor assembly 304 which is connected by gears 306 and linkages 308 in the form of chains or belts to drive the conveyor.

Positioned below load wrapping conveyor 210 and outward from the sides of conveyor 210 are film guides 220*a*, 220*b*. Each film guide 220*a*, 220*b* is constructed as discussed above with respect to FIGS. 1A and 8–10. Each film guide 220*a*, 220*b*, terminates in a tapered end at the same point that conveyor 210 terminates adjacent take-off conveyor 208. Each film guide 220*a*, 220*b*, replaces a chain (not shown), or its equivalent, such as a belt, which is customarily used to move the packaging material 214. Alternatively, the film guides 220*a*, 220*b* together may replace a secondary conveyor, placed under the load wrapping conveyor 210 and used to move the packaging material 214.

The described construction of the load wrapping conveyor 210 allows packaging material 214 to be wrapped around a load 212 which was carried from the infeed conveyor 205 onto the wrapping station 241. The packaging material 214 is wrapped around the load 212, the wrapping conveyor 210, and film guides 220*a*, 220*b*, with packaging material 214 being carried by the film guides 220*a*, 220*b* in the same direction the load 212 moves as conveyor 210 moves the load 212 and the packaging material 214. In all wrapping modes—full web, spiral and banding modes—the conveyor 210 and wrapping ring 244 are stopped and a clamp apparatus 262 clamps the packaging material web 214 and a cutter mechanism (not shown) severs the packaging material web. The conveyor 210 is then activated to carrying the load 212 and packaging material 214 downstream to a takeoff conveyor 208. When the load 212 encounters the takeoff conveyor 208, the packaging material 214, coming off the end of the load wrapping conveyor 210 and over the tapered end of rail 224 substantially simultaneously, assumes its memory position M against the load 212 in the space between the load wrapping conveyor 210 and takeoff conveyor 208, allowing the contained load 212 covered by stretch wrap to be carried away on takeoff conveyor 208.

The wrapping conveyor 210 leads from the infeed conveyor 205 to a takeoff conveyor 208 which is constructed like the infeed conveyor 205 and runs at the same speed as the infeed conveyor 205. In order to control both conveyors at the same rate of speed, a suitable mechanical means not shown is set up to make the drive of both the infeed conveyor 205 and the takeoff conveyor 208 equal to reduction gearing assembly of the drive motor. Thus, if the motor slows down or speeds up to drive the wrapping mechanism at different speeds, the infeed and takeoff conveyors simultaneously speed up or slow down so that the load moves to conveyor 210 and is taken away from the conveyor 210 at consistent relative speeds.

Figure 7:
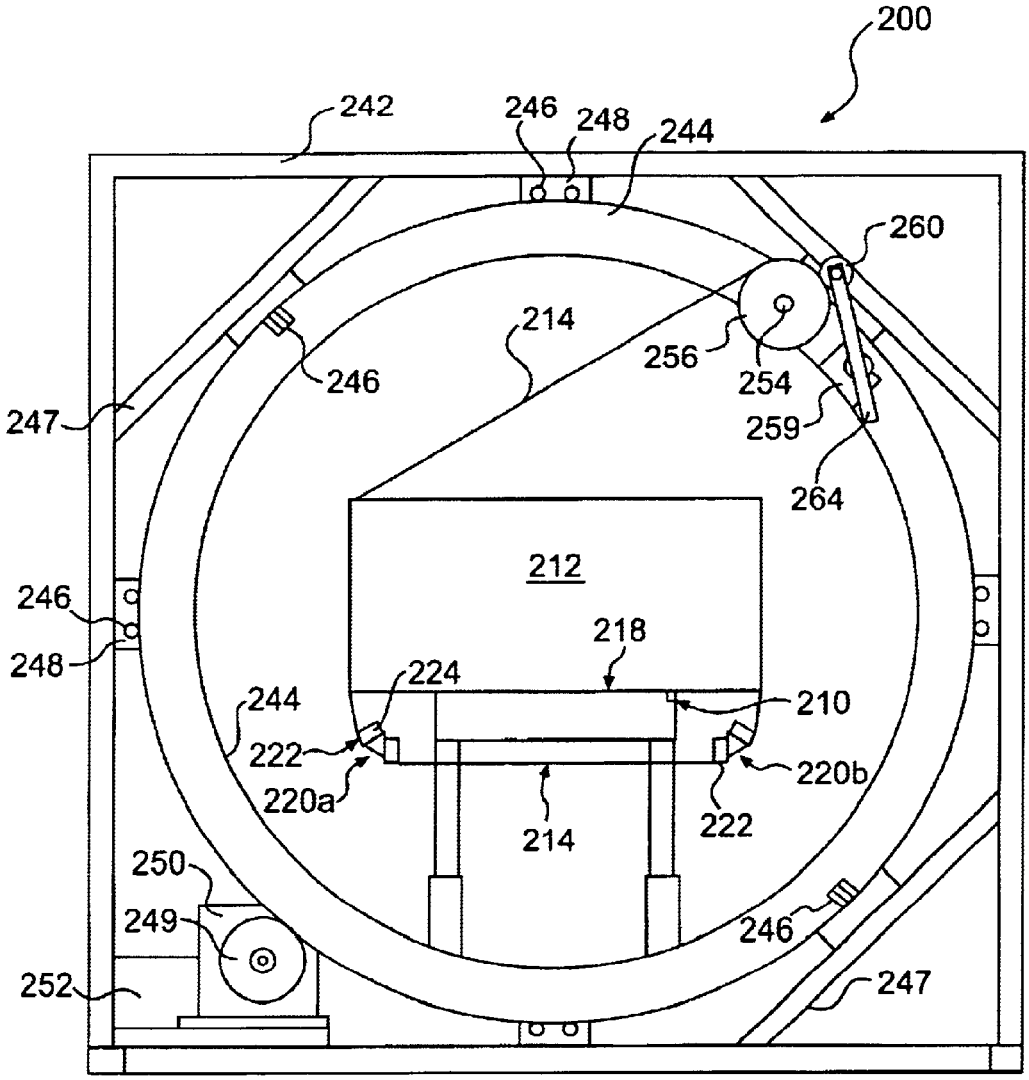
FIG. 7 is a front cross-sectional view of the apparatus of FIG. 6.

A method for wrapping a load with respect to the apparatus shown in FIGS. 6, and 7 will now be described. In the operation of the inventive wrapping apparatus, full web, spiral web, and banding modes of operation are substantially identical manner. First, film guides 220*a*, 220*b* are adjusted as necessary to accommodate the width of the load 212 to be wrapped. Additionally, film guides 220*a*, 220*b* may be rotated to optimize the amount of contact between rail 224 of film guides 220*a*, 220*b*, and the packaging material 214 to be wrapped around the load 212.

A feed conveyor 205 brings the load 212 onto the top load supporting and conveying surface 218 of load wrapping conveyor 210. Load supporting and conveying surface 218 then carries the load 212 to a predetermined wrap position within the packaging material dispensing path and the load wrapping conveyor 210 stops, leaving the load 212 in a stationary position. A leading edge 257 of the packaging material 214 is held in a clamping assembly 262 located beneath the conveyor 210 as seen in FIGS. 6 and 7.

After at least one wrap has been made around the load 212, the load wrapping conveyor 210, and the film guides 220*a*, 220*b*, the clamps are rotated releasing edge 257 which is held by the web wrap. The load is then wrapped. As the film passes over film guides 220*a*, 220*b*, the force of the film 214 is supported by film guides 220*a*, 220*b*. Preferably, within each film guide 220*a*, 220*b* the force applied by the packaging material 214 is supported evenly between the rows of wheels 222 and the rail 224. That is, in a most preferred embodiment, the rail 224 supports 50% of the force applied by the packaging material 214 and the two rows of wheels 222 support the other 50% of the force applied by the packaging material 214. The actual amount of force supported by each of the rows of wheels 222 and by the rail 224 will depend on the alignment of the film guide 220 with respect to the load 212 and to the packaging material 214 being applied.

If the wrap is for a full web load or a banded load, a plurality of overlying layers of packaging material 214 are wrapped around the load 212 and the load wrapping conveyor 210. In the spiral wrap mode, a plural number of wraps are wrapped around the downstream end of the load 212 in the same manner as the banding and the load wrapping conveyor 210 is activated, carrying the load downstream to a takeoff conveyor 208 so that a spiral wrap is formed around the load 212. When the load 212 reaches a station where the end is sensed by a feeler gauge, light sensing means, pressure sensor switch or other suitable sensing mechanism, both the takeoff conveyor 208 and the wrapping conveyor 210 stop and a second band is placed around the upstream end of the load 212 in the same manner as if a band or full web wrap were being wrapping around the load 212.

During and after wrapping of the load 212, the load 212 is conveyed toward takeoff conveyor 208. The load 212 is carried on the load supporting and conveying surface 218, and as the load 212 moves, the packaging material 214 wrapped about the load 212, film guides 220*a*, 220*b*, and wrapping conveyor 210 moves with it. In this embodiment, conventional chains (not shown) are replaced by film guides 220*a*, 220*b* for carrying the packaging material wrapped about the load 212, conveyor 210, and film guides 220*a*, 220*b*. The packaging material 214 is pulled along the non-driven wheels 222 and rail 224 of each film guide 220*a*, 220*b* by movement of the wrapped load 212 on load wrapping conveyor 210. The angle formed between the two rows of non-driven rollers 222 by the rail 224 of each film guide 220*a*, 220*b* ensures minimal friction between the packaging material 214 and the rail 224 and prevents the packaging material 214 from becoming lodged between the non-driven wheels 222 of the rows of wheels of the film guides 220*a*, 220*b*.

A space between the load wrapping conveyor 210 and the takeoff conveyor 208 allows the packaging material 214 to be discharged from film guides 220*a*, 220*b* and assume its memory position M around the load 212.

It will be apparent to those skilled in the art that various modifications and variations can be made in the present invention without departing from the spirit or scope of the invention. Thus, it is intended that the present invention cover all modifications and variations of this invention that come within the scope of the appended claims and their equivalents.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for wrapping packaging material around a top and bottom of a load, comprising:

a surface for supporting and moving a load, the surface having a longitudinal axis;

a packaging material dispenser;

means for providing relative rotation between the packaging material dispenser and the load; and at least one packaging material guide including a rail having a length and at least one row of non-driven wheels attached to a side of the rail, the at least one rail having a longitudinal axis along its length that is substantially parallel to the longitudinal axis of the surface for supporting and moving the load, wherein the wheels are positioned with respect to a surface of the rail to permit both the rail and the wheels to support a force applied by the packaging material during wrapping, and wherein the packaging material guide is moveable with respect to the surface for supporting and moving the load.

2. The apparatus of claim 1, wherein the packaging material guide is positioned above the surface for supporting and moving a load.

3. The apparatus of claim 1, wherein the packaging material guide is positioned below the load surface for supporting and moving a load.

4. The apparatus of claim 1, further comprising two packaging material guides.

5. The apparatus of claim 4, wherein one packaging material guide is positioned above the load surface for supporting and moving a load and the other packaging material guide is positioned below the load surface for supporting and moving a load.

6. The apparatus of claim 4, wherein both packaging material guides are positioned above the load surface for supporting and moving a load.

7. The apparatus of claim 4, wherein both packaging material guides are positioned below the load surface for supporting and moving a load.

8. The apparatus of claim 4, wherein the packaging material guides are moveable from a position above the load surface for supporting and moving a load to a position below the load surface for supporting and moving a load.

9. The apparatus of claim 1, wherein the packaging material guide includes two rows of non-driven wheels.

10. The apparatus of claim 9, wherein the two rows of non-driven wheels are separated by the rail.

11. The apparatus of claim 10, wherein the first of the two rows of non-driven wheels is positioned on a first side of the rail and the second of the two rows of non-driven wheels is positioned on an opposite side of the rail, and wherein the wheels of the first row form an angle of about 60 degrees with respect to the second row of wheels.

12. The apparatus of claim 9, wherein the two rows of wheels are positioned with respect to a surface of the rail to permit the rail to support 50% of a force applied by the packaging material during wrapping and the wheels to support the other 50% of a force applied by the packaging material during wrapping.

13. The apparatus of claim 1, wherein the surface for supporting and moving a load during wrapping is a conveyor.

14. The apparatus of claim 13, wherein the packaging material guide is adjacent the conveyor.

15. The apparatus of claim 13, wherein the packaging material guide is positioned away from the conveyor.

16. The apparatus of claim 13, wherein the packaging material guide is positioned below the conveyor.

17. The apparatus of claim 1, wherein the packaging material guide is moveable between a position above the surface for supporting and moving a load and a position below the surface for supporting and moving a load.

18. The apparatus of claim 1, wherein the packaging material guide is moveable between a position adjacent the surface for supporting and moving a load and a position distant from the surface for supporting and moving a load.

19. An apparatus for wrapping packaging material around a top and bottom of a load, comprising:

a load conveyor for supporting and moving a load during wrapping, the load conveyor having a longitudinal axis;

a packaging material conveyor for supporting and moving packaging material wrapped around the load and the packaging material conveyor during wrapping;

a packaging material dispenser;

means for providing relative rotation between the packaging material dispenser and the load; and at least one packaging material guide including a rail having a length and at least one row of non-driven wheels attached to a side of the rail, the at least one rail having a longitudinal axis along its length that is substantially parallel to the longitudinal axis of the load conveyor, wherein the wheels are positioned with respect to a surface of the rail to permit both the rail and the wheels to support a force applied by the packaging material during wrapping, and wherein the packaging material guide is moveable with respect to the load conveyor for supporting and moving the load.

20. The apparatus of claim 19, wherein the packaging material guide is positioned above the load conveyor.

21. The apparatus of claim 19, further comprising two packaging material guides.

22. The apparatus of claim 21, wherein the packaging material guides are positioned on either side of the load conveyor.

23. The apparatus of claim 22, wherein the packaging material guides are positioned above the load conveyor.

24. The apparatus of claim 19, wherein the packaging material conveyor includes a pair of chains.

25. The apparatus of claim 19, wherein the packaging material conveyor includes at least one powered conveyor belt.

26. An apparatus for wrapping packaging material around a top and bottom of a load in a wrapping area, comprising:

a load conveyor for supporting and moving a load, the load conveyor having a longitudinal axis;

a packaging material dispenser;

means for providing relative rotation between the packaging material dispenser and the load; and at least one packaging material guide for supporting and moving packaging material wrapped around the load, the load conveyor, and the packaging material guide during wrapping, the at least one packaging material guide including a rail having a length and at least one row of non-driven wheels attached to a side of the rail, the at least one rail having a longitudinal axis along its length that is substantially parallel to the longitudinal axis of the load conveyor, wherein the wheels are positioned with respect to a surface of the rail to permit both the rail and the wheels to support a force applied by the packaging material during wrapping, and wherein the packaging material guide is moveable with respect to the load conveyor for supporting and moving the load.

27. The apparatus of claim 26, wherein the packaging material guide is positioned below a top surface of the load conveyor.

28. The apparatus of claim 26, further comprising two packaging material guides.

29. The apparatus of claim 28, wherein the packaging material guides are positioned on either side of the load conveyor.

30. The apparatus of claim 29, wherein the packaging material guides are positioned below a top surface of the load conveyor.

31. An apparatus for wrapping packaging material around a top and bottom of a load in a wrapping area, comprising:

a surface for supporting and moving a load during wrapping, the surface having a longitudinal axis;

a packaging material dispenser; and at least one packaging material guide including a rail having a length and at least one row of non-driven wheels attached to a side of the rail for supporting and moving the packaging material below the surface during wrapping, the at least one rail having a longitudinal axis along its length that is substantially parallel to the longitudinal axis of the surface for supporting and moving the load, wherein the packaging material guide is moveable with respect to the surface for supporting and moving the load.

32. An apparatus for wrapping packaging material around a top and bottom of a load, comprising:

a surface for supporting and moving a load, the surface having a longitudinal axis;

a packaging material dispenser;

means for providing relative rotation between the packaging material dispenser and the load; and at least one packaging material guide including a rail having a length and at least one row of non-driven wheels attached to a side of the rail, the at least one rail having a longitudinal axis along its length that is substantially parallel to the longitudinal axis of the surface for supporting and moving the load, wherein the packaging material guide is movable from a position above the surface to a position below the surface to position the wheels and a surface of the rail to support a force applied by the packaging material during wrapping.

33. An apparatus for wrapping packaging material around a top and bottom of a load, comprising:

a surface for supporting and moving a load;

a packaging material dispenser;

means for providing relative rotation between the packaging material dispenser and the load around an axis of rotation; and at least one packaging material guide including a rail having a length and at least one row of non-driven wheels attached to a side of the rail, the at least one rail having a longitudinal axis along its length that is substantially parallel to the axis of rotation, wherein the wheels are positioned with respect to a surface of the rail to permit both the rail and the wheels to support a force applied by the packaging material during wrapping, and wherein the packaging material guide is moveable with respect to the surface for supporting and moving the load.

34. An apparatus for wrapping packaging material around a top and bottom of a load, comprising:

a load conveyor for supporting and moving a load during wrapping;

a packaging material conveyor for supporting and moving packaging material wrapped around the load and the packaging material conveyor during wrapping;

a packaging material dispenser;

means for providing relative rotation between the packaging material dispenser and the load around an axis of rotation; and at least one packaging material guide including a rail having a length and at least one row of non-driven wheels attached to a side of the rail, the at least one rail having a longitudinal axis along its length that is substantially parallel to the axis of rotation, wherein the wheels are positioned with respect to a surface of the rail to permit both the rail and the wheels to support a force applied by the packaging material during wrapping, and wherein the packaging material guide is moveable with respect to the load conveyor for supporting and moving the load.

35. An apparatus for wrapping packaging material around a top and bottom of a load in a wrapping area, comprising:

a load conveyor for supporting and moving a load;

a packaging material dispenser;

means for providing relative rotation between the packaging material dispenser and the load around an axis of rotation; and at least one packaging material guide for supporting and moving packaging material wrapped around the load, the load conveyor, and the packaging material guide during wrapping, the at least one packaging material guide including a rail having a length and at least one row of non-driven wheels attached to a side of the rail, the at least one rail having a longitudinal axis along its length that is substantially parallel to the axis of rotation, wherein the wheels are positioned with respect to a surface of the rail to permit both the rail and the wheels to support a force applied by the packaging material during wrapping, and wherein the packaging material guide is moveable with respect to the load conveyor for supporting and moving the load.

36. An apparatus for wrapping packaging material around a top and bottom of a load, comprising:

a surface for supporting and moving a load;

a packaging material dispenser;

means for providing relative rotation between the packaging material dispenser and the load around an axis of rotation; and at least one packaging material guide including a rail and at least one row of non-driven wheels attached to a side of the rail, the at least one rail having a longitudinal axis substantially parallel to the axis of rotation, wherein the packaging material guide is movable from a position above the surface to a position below the surface to position the wheels and a surface of the rail to support a force applied by the packaging material during wrapping.

* * * * *